US005095974A

United States Patent [19]

Pyc

[11] Patent Number: 5,095,974

[45] Date of Patent: Mar. 17, 1992

[54] ASSEMBLY FOR INTRODUCING STEAM INTO AN OIL-BEARING STRATUM

[75] Inventor: Ireneusz Pyc, Bubenreuth, Fed. Rep. of Germany

[73] Assignee: Forschungszentrum Julich GmbH, Julich, Fed. Rep. of Germany

[21] Appl. No.: 651,273

[22] Filed: Feb. 5, 1991

[30] Foreign Application Priority Data

Feb. 12, 1990 [DE] Fed. Rep. of Germany ..... 4004240

[51] Int. Cl.[5] ..... E21B 36/02

[52] U.S. Cl. ..... 166/57; 166/303

[58] Field of Search ..... 166/57, 303, 272

[56] References Cited

U.S. PATENT DOCUMENTS

| | | | |
|---|---|---|---|
| 3,142,336 | 7/1964 | Doscher | 166/57 X |
| 4,250,963 | 2/1981 | Hess | 166/303 X |
| 4,366,860 | 1/1983 | Donaldson et al. | 166/303 X |
| 4,399,865 | 8/1983 | Anderson et al. | 166/57 X |
| 4,463,803 | 8/1984 | Wyatt | 166/303 X |

*Primary Examiner*—Thuy M. Bui

*Attorney, Agent, or Firm*—Herbert Dubno

[57] ABSTRACT

A steam generator lowered into a steam injection well for tertiary oil recovery has a conical bottom which cooperates with a conical support surface on a tube segment affixed to the casing of the well. The steam pipe passes through an opening at the apex of the conical support which centers the steam generator as it is lowered in place. The sealing is effected by a seal pressed by the weight of the steam generator between its conical bottom and the conical support surface.

3 Claims, 1 Drawing Sheet

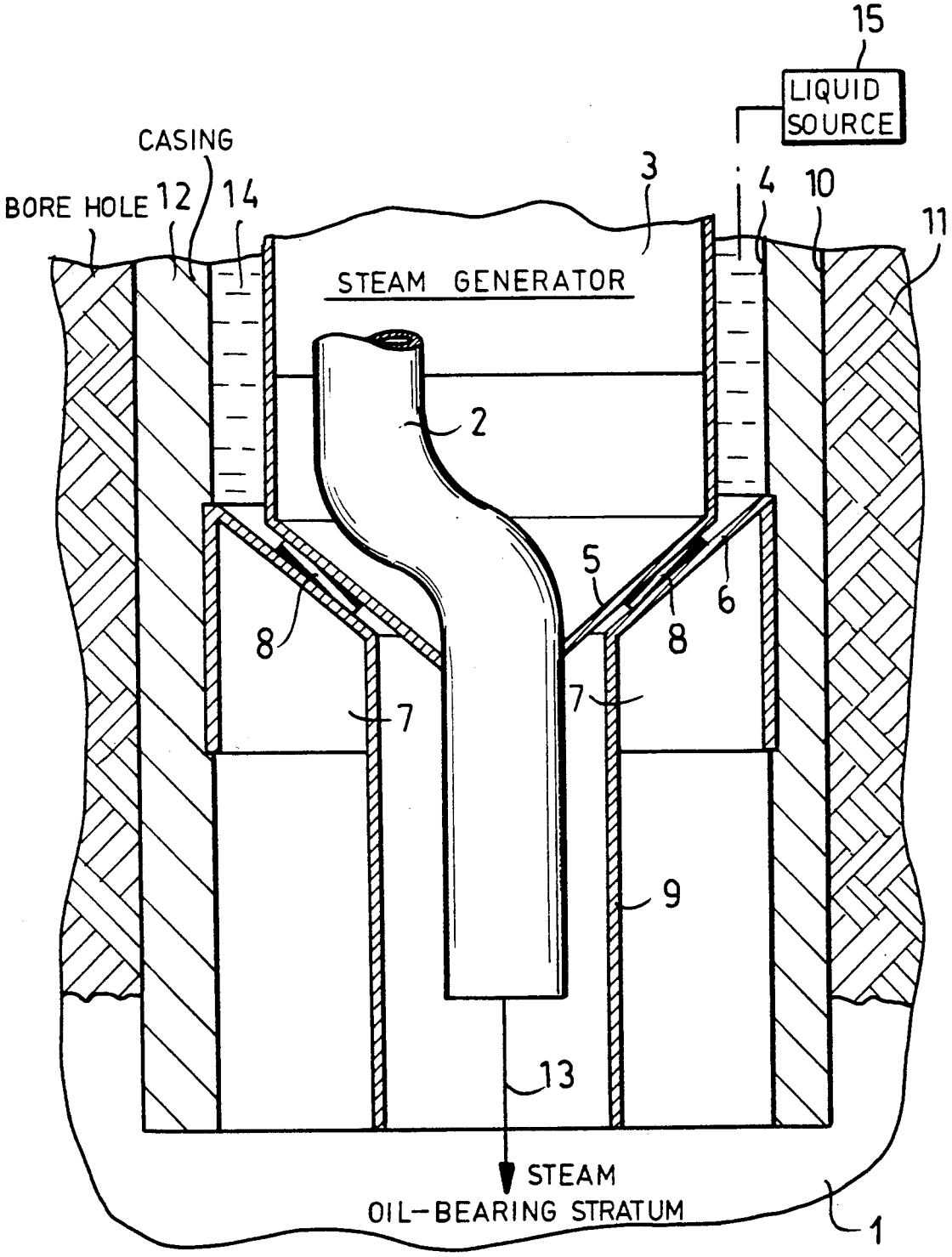
15
LIQUID SOURCE
CASING
BORE HOLE
12
14
3
4
10
11
STEAM GENERATOR
2
5
6
8
8
7
7
9
13
STEAM
OIL-BEARING STRATUM
1

ASSEMBLY FOR INTRODUCING STEAM INTO AN OIL-BEARING STRATUM

FIELD OF THE INVENTION

My present invention relates to an assembly for introducing steam into an oil-bearing stratum and, more particularly, to a sealing system for sealing a steam-supply pipe in a bore hole running to an oil-bearing stratum.

BACKGROUND OF THE INVENTION

From the commonly assigned U.S. Pat. No. 4,765,406 and its German counterpart DE-A-36 12 946, it can be seen that an apparatus for generating steam can be used to supply the steam of a petroleum-bearing stratum for tertiary recovery of crude oil. The temperature increase in the oil-bearing stratum reduces the viscosity of the crude oil to make the crude oil flowable and pumpable, i.e. more mobile so that the mobilized crude oil can be extracted by pumping from the oil-bearing stratum.

For that purpose, the steam generator can, in whole or in part, be received within the cased bore hole and can have a pipe (steam delivery pipe) which extends from the steam generator within the cased bore hole to deliver the steam to the oil-bearing stratum.

Problems have been encountered heretofore with the sealing of the steam pipe with respect to the casing or wall of the bore hole since the steam is delivered under pressure to the oil-bearing stratum and when this stratum is under pressure. The unblocked mouth of the steam-delivery pipe must be sealed with respect to the bore hole space above the seal if steam pressure is to be maintained in the oil-bearing stratum.

OBJECTS OF THE INVENTION

It is, therefore, the principal object of the present invention to provide a sealing system for the steam-delivery pipe of a system of the type described which will ensure an effective gas-tight seal of the pipe with respect to the bore hole wall or casing.

Another object of this invention is to provide an improved assembly for introducing steam into an oil-bearing stratum whereby disadvantages of earlier systems can be avoided.

Still another object of my invention is to provide an assembly for introducing steam into an oil-bearing stratum for tertiary crude oil production which has an improved seal between the steam-generating assembly and the wall of the bore hole.

SUMMARY OF THE INVENTION

These objects and others which will become apparent hereinafter are attained, in accordance with the invention, by providing the cased bore hole with at least one casing pipe in the vicinity of the bottom of the casing with a conically-shaped support surface through an open conical apex of which the steam pipe opens into an oil-bearing stratum.

The steam pipe can extend through a steam-generator bottom which is shaped to be complementary to the conical support surface of the casing or pipe bottom and, according to the invention, between the steam-generator bottom and the conical supporting surface of the pipe bottom, an annular seal is provided which is pressed or compressed by the weight of the steam generator bearing thereon and supported by the conical surface of the casing.

More specifically, an assembly for introducing steam into an oil-bearing stratum, can comprise:

a cased borehole extending downwardly to an oil-bearing stratum;

a pipe bottom received in the cased borehole and formed with a conically converging inwardly extending support having a central opening;

an annular seal on the conically converging inwardly extending support surrounding the opening;

a steam generator received in the cased borehole and formed with a conically converging inwardly extending steam-generator bottom complementary to the pipe bottom and resting upon the seal while pressing with the weight of the steam generator thereagainst for sealing off the cased borehole below the steam generator; and a steam pipe extending downwardly from the steam generator through the opening and freely discharging steam into the oil-bearing stratum.

According to a feature of the invention, the support can be formed with a downwardly-extending tube surrounding this opening and forming a guide for the steam pipe.

The support and the steam-generator bottom preferably converge downwardly.

The system of the invention thus provide a pipe bottom on the casing and a steam-generator bottom on the steam generator assembly which have conical surfaces juxtaposed with one another and between which the seal, which can be of rectangular cross section and composed of an elastic material, can be disposed.

The simplification afforded by the instant invention, wherein the sealing force results exclusively from the weight of the steam generator and nothing attached thereto above the conical steam-generator bottom, eliminates the need for complex sealing arrangements. The sealing of the steam feed pipe with respect to the interior of the bore hole thus is effected automatically upon lowering of the steam generator into the bore hole. The conical form of the support and steam-generator bottom serves to center the steam generator as it is lowered into the bore hole. No additional means is required for generating compression in the seal between the steam pipe and the casing of the bore hole.

BRIEF DESCRIPTION OF THE DRAWING

The above and other objects, features and advantages of the present invention will become more readily apparent from the following description, reference being made to the accompanying drawing, the sole FIGURE of which is a diagrammatic axial cross sectional view of the lower part of a steam generator and the remainder of the assembly according to the invention.

SPECIFIC DESCRIPTION

The drawing shows the bottom region of a bore hole formed through numerous strata between an oil-bearing stratum 1 and the ground surface (not shown), the bore hole itself being represented at 10 and the strata through which it extends being represented at 11. The bore hole is cased with a casing 12, the inner wall of which is represented at 4.

A steam-delivery pipe 2 opens into this oil-bearing stratum 1 to deliver steam thereto as represented by the arrow 13 to heat the oil-bearing stratum and reduce the viscosity of the petroleum stored therein so that the crude oil is thereby mobilized and can be pumped to the surface through recovery wells communicating with the oil-bearing stratum and generally in the region, the steam injection well represented in the drawing.

The viscosity reduction makes the oil pumpable. For this end and as described in U.S. Pat. No. 4,765,406, the steam pipe 2 is connected to a steam generator 3 which has been shown only in part but which may be identical otherwise to the steam generator of this last-mentioned patent. The steam is introduced into the stratum 1 under pressure.

The steam generator 3 is disposed with spacing from the cased bore hole wall 4 and rests with its generator bottom 5 upon a support surface 6 of a pipe bottom 7 anchored to the casing 4, e.g. by welding. The steam-generator bottom 7 and the support surface 6 are conically configured and complementary to one another, i.e. the half angles or apex angles of the two cones being identical.

Between the steam-generator bottom 5 and the support surface 6, an annular seal 8 is disposed, the seal having a generally rectangular cross section and conforming to the conical configurations of the two surfaces between which it is sandwiched. After mounting of the steam generator in the bore hole, the steam generator rests with its weight upon the seal so that the seal 8 is compressed between the steam-generator bottom and the support surface 6.

The apex angles of the steam-generator bottom 5 and the support surface 6 can be selected in dependence upon the material of the seal so that the steam generator weight is sufficient to completely seal the bore hole against the steam pressure which is generated in the oil-bearing stratum.

The pipe bottom 7 has a guide piece 9 for the steam pipe 2 which extends downwardly. Within the guide piece 9, the steam pipe 2 opens freely above the oil-bearing stratum 1 to permit the steam to flow freely into the oil-bearing stratum to heat it.

To increase the pressure on the seal, in the space between the wall 4 and the steam generator, liquid 14 can be introduced, e.g. from a source 15. The liquid pressure can act upon the steam generator forcing it downwardly. By appropriate shaping of the seal and its positioning between the steam-generator-bottom 5 and the support surface 6, it is possible to additionally increase the sealing effect if desired.

Upon mounting of the steam generator in the bore hole, the steam generator and steam pipe 2 are centered in the bore hole by the interaction of the steam-generator bottom and the support surface as a consequence of their conical shapes. Additional clamping for sealing of the steam pipe is not required.

I claim:

1. An assembly for introducing steam into an oil-bearing stratum, comprising:

a cased borehole extending downwardly to an oil-bearing stratum;

a pipe bottom received in said cased borehole and formed with a conically converging inwardly extending support having a central opening;

an annular seal on said conically converging inwardly extending support surrounding said opening;

a steam generator received in said cased borehole and formed with a conically converging inwardly extending steam-generator bottom complementary to said pipe bottom and resting upon said seal while pressing with the weight of said steam generator thereagainst for sealing off said cased borehole below said steam generator; and a steam pipe extending downwardly from said steam generator through said opening and freely discharging steam into said oil-bearing stratum.

2. The assembly for introducing steam into an oil-bearing stratum defined in claim 1 wherein said support is formed with a downwardly extending tube surrounding said opening and forming a guide for said steam pipe.

3. The assembly for introducing steam into an oil-bearing stratum defined in claim 1 wherein said support and said steam-generator bottom converge downwardly.

* * * * *